US006245386B1

(12) United States Patent
Felker et al.

(10) Patent No.: US 6,245,386 B1
(45) Date of Patent: Jun. 12, 2001

(54) METHOD AND SYSTEM FOR FINISHING A GOLF BALL

(75) Inventors: David L. Felker, Bonsall; David M. Bartels, San Diego, both of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/558,710

(22) Filed: Apr. 26, 2000

(51) Int. Cl.[7] ..... B05D 1/36; B05D 1/28; A63B 37/00

(52) U.S. Cl. ..... 427/258; 427/286; 427/322; 427/407.1; 427/429; 473/351

(58) Field of Search ..... 427/286, 258, 427/322, 407.1, 429; 473/351; 118/500, 503; 101/DIG. 40

(56) References Cited

U.S. PATENT DOCUMENTS

| | | | | |
|---|---|---|---|---|
| 2,539,303 | | 1/1951 | Gerke et al. . | |
| 3,647,221 | * | 3/1972 | Holley | 273/235 |
| 4,361,111 | * | 11/1982 | Groen | 118/503 |
| 4,613,403 | | 9/1986 | Oyachi et al. . | |
| 4,679,794 | | 7/1987 | Yamada et al. . | |
| 4,679,795 | | 7/1987 | Melvin et al. . | |
| 4,731,262 | | 3/1988 | Ohno et al. . | |
| 4,798,386 | | 1/1989 | Berard . | |
| 4,802,674 | | 2/1989 | Kitaoh . | |
| 4,846,098 | | 7/1989 | Kobayashi et al. . | |
| 4,865,326 | | 9/1989 | Isaac et al. . | |
| 4,871,589 | | 10/1989 | Kitaoh et al. . | |
| 5,000,458 | | 3/1991 | Proudfit . | |
| 5,006,297 | * | 4/1991 | Brown et al. | 264/234 |
| 5,018,742 | | 5/1991 | Isaac et al. . | |
| 5,029,870 | | 7/1991 | Concepcion et al. . | |
| 5,106,651 | | 4/1992 | Tyger et al. . | |
| 5,156,405 | | 10/1992 | Kitaoh et al. . | |
| 5,160,536 | | 11/1992 | Harris et al. . | |
| 5,200,438 | | 4/1993 | Fujii et al. . | |
| 5,300,325 | | 4/1994 | Nealon et al. . | |
| 5,316,739 | | 5/1994 | Yoshikawa et al. . | |
| 5,409,233 | | 4/1995 | Kennedy . | |
| 5,409,974 | | 4/1995 | Sullivan et al. . | |
| 5,456,954 | | 10/1995 | Sullivan . | |
| 5,459,220 | | 10/1995 | Kennedy . | |
| 5,461,109 | | 10/1995 | Blair et al. . | |
| 5,466,424 | | 11/1995 | Kusano et al. . | |
| 5,494,291 | | 2/1996 | Kennedy . | |
| 5,502,100 | | 3/1996 | Maruoka et al. . | |
| 5,506,004 | * | 4/1996 | Maruoka et al. | 427/425 |
| 5,506,292 | | 4/1996 | Horiuchi et al. . | |
| 5,540,438 | | 7/1996 | Horiuchi et al. . | |
| 5,542,680 | | 8/1996 | Proudfit et al. . | |
| 5,552,190 | | 9/1996 | Maruoka et al. . | |
| 5,580,323 | | 12/1996 | Sullivan . | |
| 5,634,399 | | 6/1997 | Pepin et al. . | |
| 5,695,414 | | 12/1997 | Yokota . | |
| 5,725,443 | | 3/1998 | Sugimoto et al. . | |
| 5,766,097 | | 6/1998 | Horiuchi et al. . | |

(List continued on next page.)

FOREIGN PATENT DOCUMENTS

| | | | |
|---|---|---|---|
| 4-314428 | | 11/1992 | (JP) . |
| 8-318186 | * | 12/1996 | (JP) . |

*Primary Examiner*—Shrive Beck
*Assistant Examiner*—Michael Barr
(74) *Attorney, Agent, or Firm*—Michael A. Cantania

(57) ABSTRACT

A method and system for finishing a golf ball to prevent tip marks is disclosed herein. The present invention includes whitening a portion of a golf ball, then positioning the golf ball in such manner that the tips of a carrier engage the whitened portion. The whitening may be accomplished by inkjet, pad printing or painting.

9 Claims, 8 Drawing Sheets

U.S. PATENT DOCUMENTS

| | | |
|---|---|---|
| 5,770,325 | 6/1998 | Keller et al. . |
| 5,778,793 | 7/1998 | Mello et al. . |
| 5,785,612 | 7/1998 | Shapiro et al. . |
| 5,789,486 | 8/1998 | Maruoka et al. . |
| 5,816,943 | 10/1998 | Masutani et al. . |
| 5,840,788 | 11/1998 | Lutz et al. . |
| 5,868,840 | 2/1999 | Klein, II et al. . |
| 5,878,670 | 3/1999 | Yamaguchi . |
| 5,885,173 | 3/1999 | Keller . |
| 5,957,785 | 9/1999 | Masutani et al. . |
| 5,967,906 | 10/1999 | Horiuchi et al. . |
| 5,968,605 | 10/1999 | Lutz . |
| 5,972,111 | 10/1999 | Anderson . |
| 5,985,370 | 11/1999 | Ohira et al. . |
| 5,989,644 | 11/1999 | Williams . |
| 5,997,417 | 12/1999 | Lutz . |
| 6,001,177 | 12/1999 | Gendreau et al. . |
| 6,001,898 | 12/1999 | Lutz . |
| 6,013,330 | 1/2000 | Lutz . |
| 6,057,043 | 5/2000 | Kametani et al. . |

* cited by examiner

METHOD AND SYSTEM FOR FINISHING A GOLF BALL

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to finishing a golf ball. More specifically, the present invention relates to applying a base coat to an unfinished golf ball for cosmetic purposes.

2. Description of the Related Art

Golfers want white golf balls, and golfers expect that premium priced golf balls will be white without any discoloration. In order to provide golfers with premium white golf balls, the golf industry has either doped the cover material with whitening agents, or applied two base coats to the cover of the golf ball. The doped covers are white, and only need indicia and clear coat for finishing. The two base coat method is usually used when the cover material is such that whitening agents are insufficient to properly whiten the golf ball. The two base coat system is typically used with polyurethane covers, particularly aromatic polyurethane covers which have a greater tendency to yellow upon exposure to ultraviolet light.

In the two base coat method, a golf ball is held in a three-prong device during the application of the base coats. The first base coat is applied and cured, and then a second base coat is applied and cured to the golf ball. The golf ball is either removed from the three-prong device, or repositioned prior to application of the second base coat. If only one base coat is utilized, the tip ends of the three-prong device create a tip mark where the base coat was not applied to the golf ball. The repositioning and application of the second base coat is the obvious solution to resolve the problem with tip marks.

However, due to present processing techniques, the entire golf ball has to be covered in two base coats to prevent tip marks. This is an inefficient use of resources, and also increases the production cycle for finishing a golf ball. What is needed is a means to prevent tip marks without repeating the application of a base coat on a golf ball.

BRIEF SUMMARY OF THE INVENTION

The present invention provides a solution to the problem of tip marks on golf balls without having to apply two base coats on a golf ball prior to application of an indicia and/or clear coat. The present invention overcomes the tip mark problem by whitening a portion of the golf ball surface, and then placing the golf ball in a carrier such that the tips of the carrier engage the whitened portion of the golf ball.

One aspect of the present invention is a method for finishing a golf ball. The method includes whitening a tip region on a surface of the golf ball. Next, the golf ball is held in a plurality of tips that engage the tip region. Next, a base coat is applied to the surface of the golf ball while the golf ball is held in the plurality of tips. Then, a clear coat is applied to the surface of the golf ball.

Another aspect of the present invention is a system for finishing a golf ball. The system includes whitening means, transfer means, and coating stations. The whitening means whitens a tip region on a surface of a golf ball. The transfer means transfers a golf ball along a predetermined path of the system. A base coat application station is disposed subsequent to the whitening means on the predetermined path. The base coat application station has a painting booth with at least one spray gun for applying a base coat to a golf ball. A curing station is disposed subsequent to the base coat application station on the predetermined path. A clear coat application station is disposed subsequent to the curing station on the predetermined path.

Whitening of a portion of the golf ball may be accomplished by an inkjet, a pad printer, a paint nozzle, or application of a hot stamp decal.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
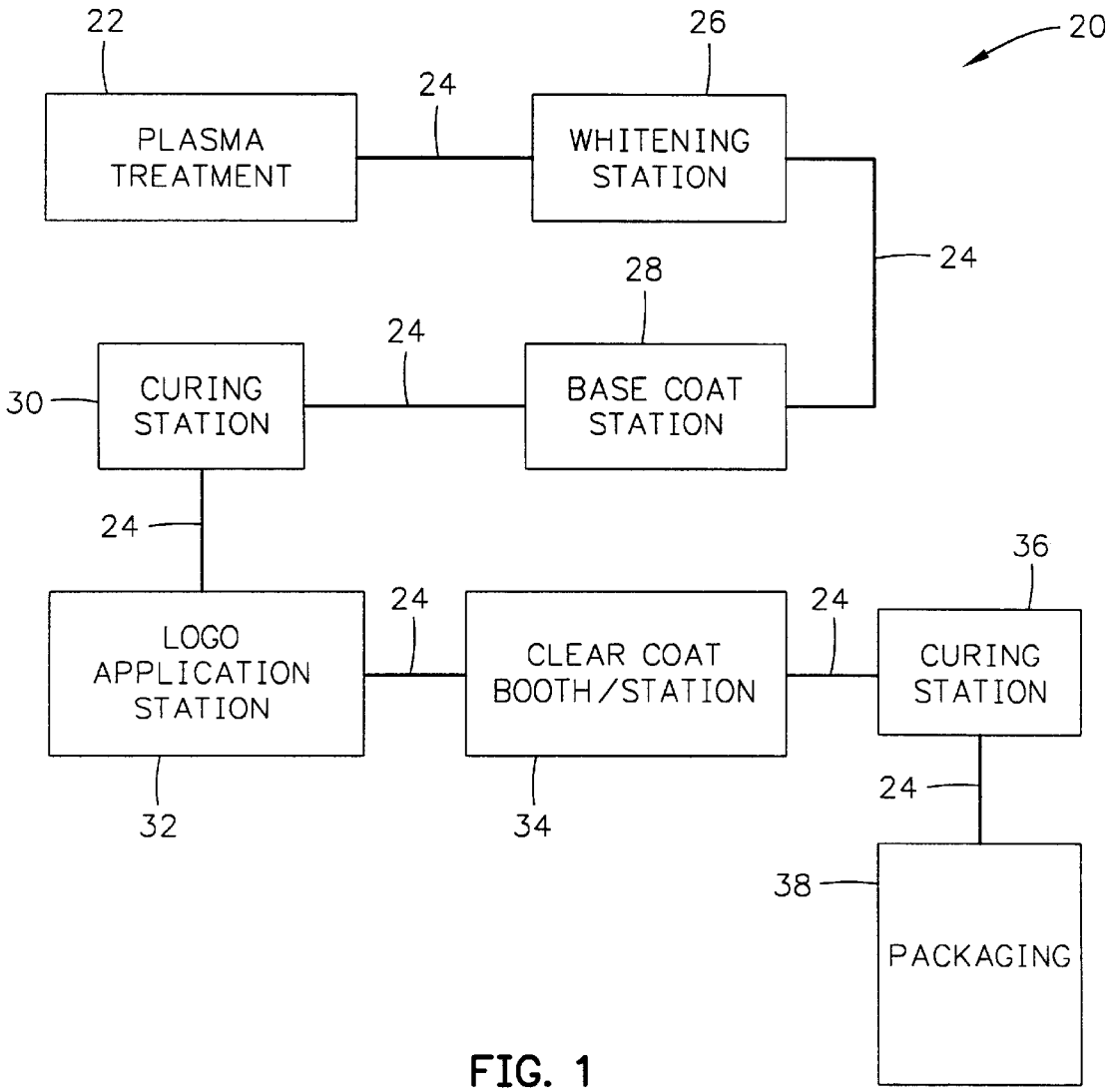
FIG. 1 is a schematic diagram of the system of the present invention.

As shown in FIG. 1, a system for whitening a portion of an unfinished golf ball is generally designated 20. Preferably, the system 20 is completely automatic thereby allowing for the finishing, or painting, of golf balls without operator involvement in the process. The system 20 includes a transfer means 24 for transferring a plurality of golf balls 25, not shown, from and to each of the stations of the system 20. The transfer means 24 may be a conveyor system that transfers each of the golf balls 25 individually, or a conveyance system that transfers the golf balls 25 in groups throughout the system. The golf balls 25 are transferred from other processes to a collection hopper, not shown, for finishing of the golf ball 25 on the system 20. The other processes may include core forming processes and cover forming processes. The cover may be composed of a thermoplastic material or a thermosetting material such as a polyurethane material. Prior to placement in the collection hopper, the golf balls 25 may be fed through a vibratory wash to remove any dust particles or other foreign matter from the surface of each of the golf balls 25.

The collection hopper automatically loads the golf balls 25 onto a conveyor for transfer through a surface treatment station 22. The surface treatment station 22 increases the surface tension of the exterior of each of the golf balls 25, and chemically alters the surface material of each of the golf balls 25. The higher surface tension on the exterior of each of the golf balls 25 assures a uniform flow of paint, thereby eliminating or at least reducing pooling of paint in the dimples of each of the golf balls 25. Preferably, the surface treatment station is a plasma treatment. However, alternative surface treatments include flame ionization, flame reduction/oxidation, corona discharge, and the like. The plasma treatment process consists of bombardment of air with a high-energy electrical plasma arc that creates ionized gases that contain ions, electrons, radicals, excited molecules and atoms. The ionized gases react with the surface of each golf ball 25 to cause polymer chain scission, ablation, cross-linking and oxidation to a depth ranging from fifty to five-hundred Angstroms from the surface of the golf ball 25. Essentially highly reactive and potential bonding sites are created on the surface of the golf ball 25 in order to increase adhesion of the base coat or primer. The plasma treatment process is performed at ambient air temperatures and at standard atmospheric conditions (25° C. and 1 atm.) as opposed to high temperature and vacuum conditions associated with conventional plasma treatment devices. The residence time in the plasma treatment station 22 may be regulated according to the chemistry requirements of the surface material. Such a plasma treatment system is described in Leach et al., U.S. Pat. No. 3,428,801, which is hereby incorporated by reference in its entirety.

After the surface treatment station 22, each of the golf balls 25 is transported to the transfer means 24 for conveyance to the next station. The next station is the whitening station 26 where a portion of each of the golf balls 25 is whitened to overcome the problem with tip marks. The whitening station 26 will be described in greater detail below. Once each golf ball 25 is whitened, the transfer means 24 transports each golf ball 25 to the next station.

Once on the transfer means 24, each of the golf balls 25 is conveyed to a first coating station 28. At the first coating station 28, a base coat is applied to each of the whitened golf balls 25. The base coat is typically a two-component polyurethane white paint. One example of a two-component polyurethane white paint is based on DESMODUR® polyol and urethane resins available from the Bayer Corporation of Pittsburgh, Pa. After the first coat or base coat is applied to each of the golf balls 25, the golf balls 25 are conveyed by the transfer means 24 to the first curing station 30. In a preferred embodiment, the first curing station 30 is a typical convection heating oven for curing the base coat that was previously applied to each of the golf balls 25. The first curing station 30 cures the golf balls 25 for application of indicia thereon at the next station.

After curing, the golf balls 25 are conveyed on the transfer means 24 to an indicia application station 32 for application of an indicia onto each of the golf balls 25. In a preferred embodiment, the indicia application station 32 is a pad printing station. Each of the golf balls 25 may be marked with indicia using an ink. A preferred ink is an ultraviolet light curable ink such as UVA available from Trans Tech of Chicago, Ill. After the indicia are applied, each of the golf balls 25 is cured at the indicia application station 32. In a preferred embodiment, the indicia curing is ultraviolet light curing.

From the indicia application station 32, each of the golf balls 25 is conveyed to a second coating station 34. In a preferred embodiment, the second coating station 34 is a topcoat application station. The topcoat is typically a two-component polyurethane coating that may be based on DESMODUR® polyols and urethane prepolymers available from the Bayer Corporation of Pittsburgh, Pa. After the second coat or topcoat is applied to each of the golf balls 25, the golf balls 25 are conveyed by the transfer means 24 to a second curing station 36. In a preferred embodiment, the second curing station 36 is a typical convection heating oven for curing the topcoat that was previously applied to each of the golf balls 25. After curing, each of the golf balls 25 is conveyed to a packaging station 38 for packaging and distribution.

Alternatively, the topcoat may be applied to each of the golf balls 25 prior to application of the indicia. In such an embodiment, the second coating station 34 and second curing station 36 would be disposed prior to the indicia application station 32 on the system 20.

Figure 1A:
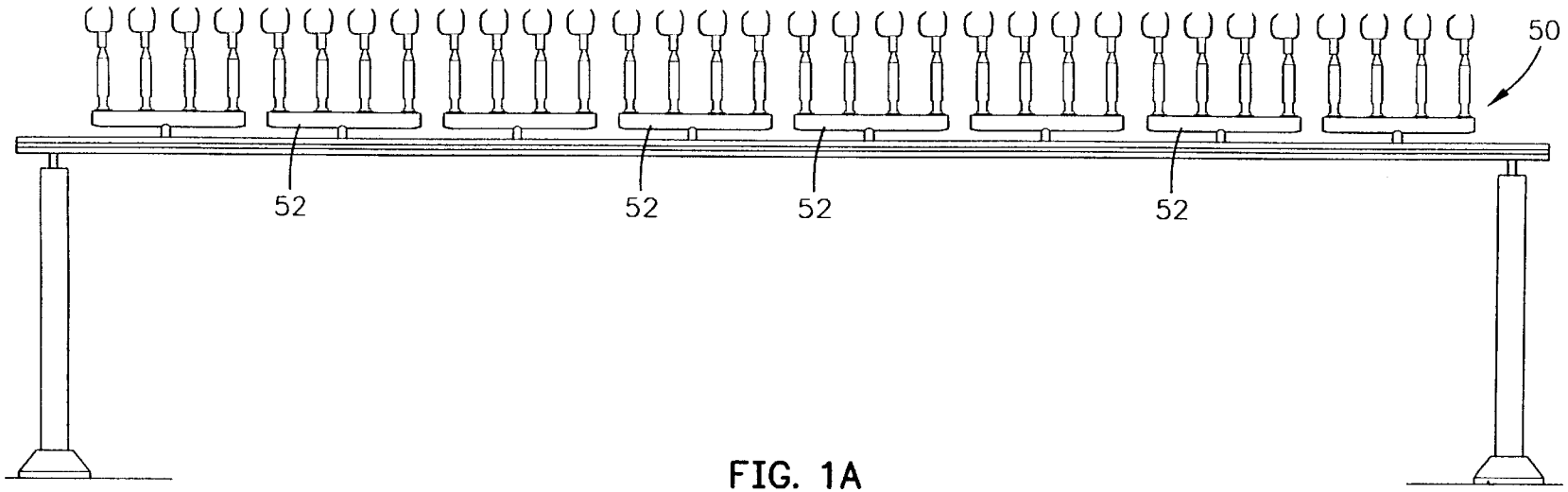
FIG. 1A is a side view of the transfer means.
Figure 1B:
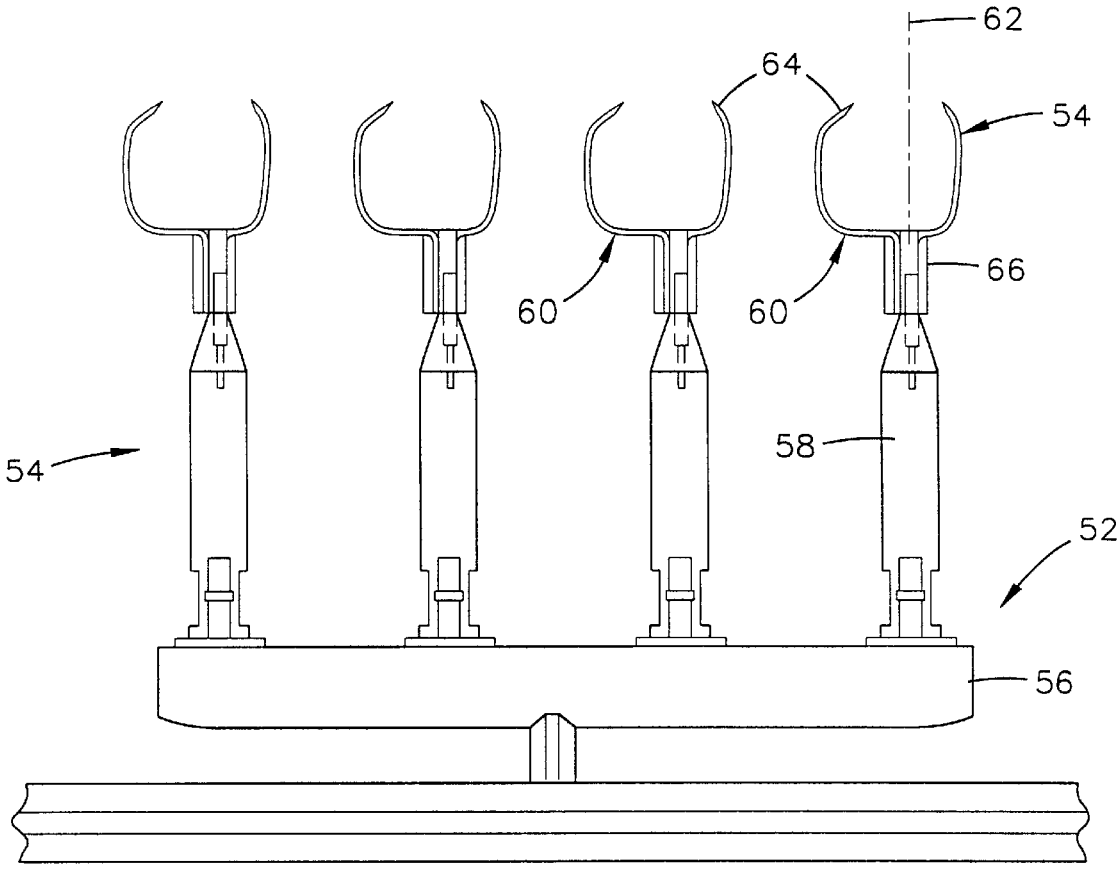
FIG. 1B is an isolated view of a carrier base for carry golf balls along the system.
Figure 1C:
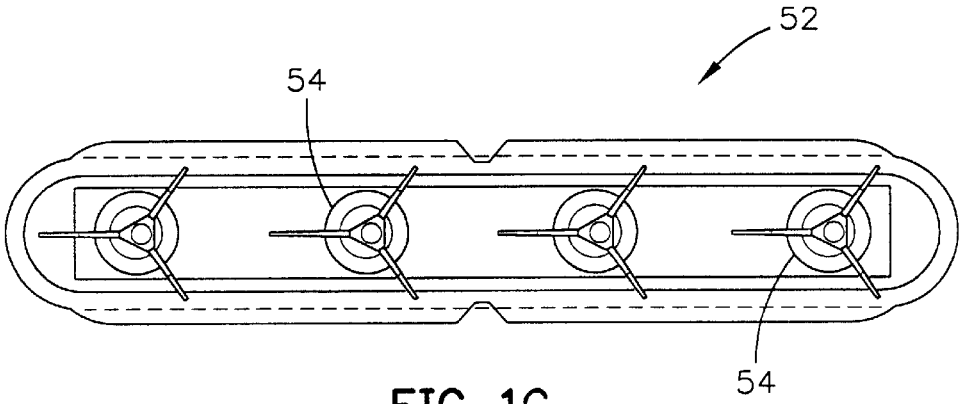
FIG. 1C is a top view of FIG. 1B.
Figure 1D:
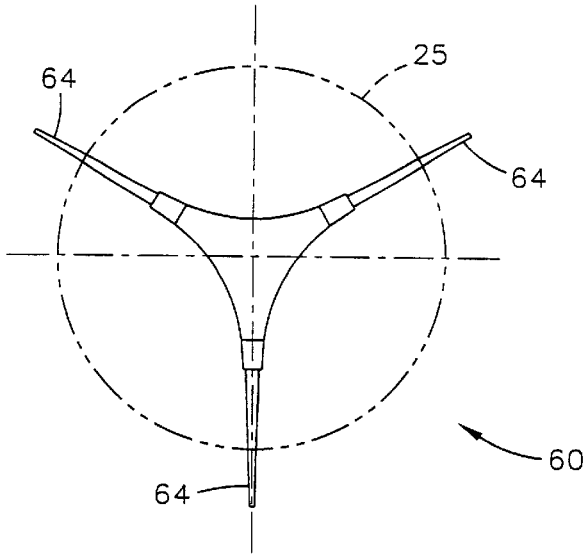
FIG. 1D is an isolated top view of a prong for carrying a golf ball.
Figure 1E:
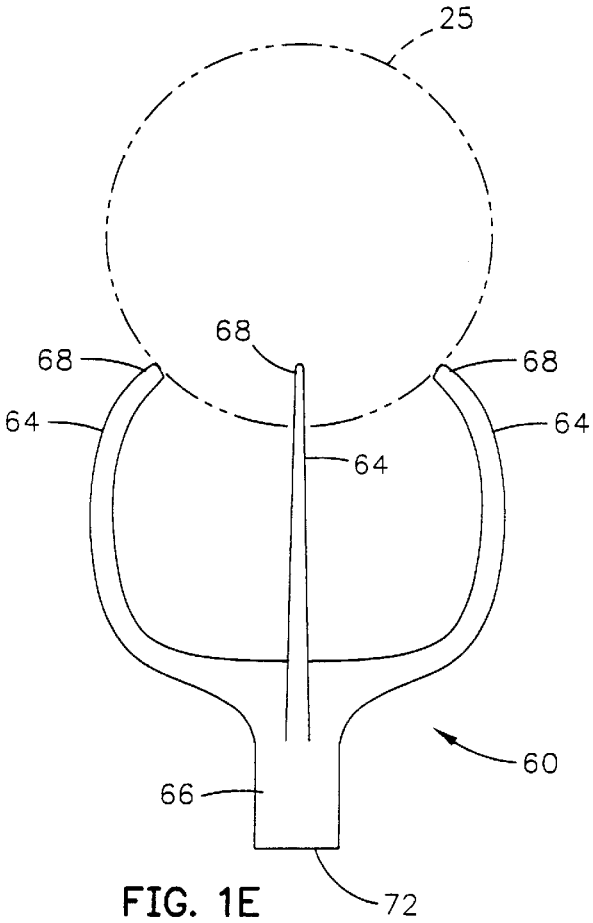
FIG. 1E is a side view of FIG. 1D.

As illustrated in FIG. 1A, the golf balls 25 are transferred along the system 20 by a transfer means 24. In a preferred embodiment, the transfer means 24 is an SKF conveyor 50 utilizing a plurality of transport pucks 52 to move groups of the golf balls 25 along the system 20. The speed of the SKF conveyor 50 is controllable for proper movement timing of the transport pucks 52 between stations. The SKF conveyor 50 is typically not enclosed and thus the transport pucks 52 are open to the environment during movement between stations. This open conveyance allows for easier maintenance of the transfer means 24. Further, the SKF conveyor 50 is modular, and thus can be structured to accommodate adjustments in the length and placement of the system 20.

As shown in FIGS. 1B, 1C, 1D and 1E, each transport puck 52 has a plurality of golf ball holding fixtures 54 and a base 56. Typically, each transport puck 52 has four fixtures 54. The fixtures 54 are disposed on the base 56, and each fixture 54 may be removable or permanently attached to the base 56. Each base 56 is disposed on the SKF conveyor 50 for movement about the system 20. Each of the fixtures 54 has a shaft 58 topped with a spindle 60. Each of the spindles 60 rotates about an imaginary fixed vertical axis 62 through the center of each corresponding shaft 58. Each spindle 60 has a plurality of prongs 64 for holding a golf ball 25 as the golf ball 25 is processed through the system 20, and each spindle 60 is removable form each corresponding shaft 58. The prongs 64 project upward from a spindle base 66, and are shaped to accommodate a golf ball 25. A United States Golf Association approved golf ball 25 has a diameter of at least 1.680 inches. In the preferred embodiment, the prongs 64 form a phantom diameter 70 (indicated by dashed lines) that is 1.437 inches in diameter. At the end of each prong 64 is a tip 68 that engages the golf ball 25.

The whitening station 26 overcomes the problem of tip marks on a golf ball 25 from the tips 68 of the prongs 64 that hold the golf ball 25 during the finishing process. The whitening station 26 is integrated into the system 20 to whiten a portion of the golf ball 25 that is engaged by the tips 68, during the finishing process. Instead of applying two base coats to an unfinished golf ball, the present invention whitens only a portion of the unfinished golf ball using various techniques that are integrally designed into the system 20.

Figure 2:
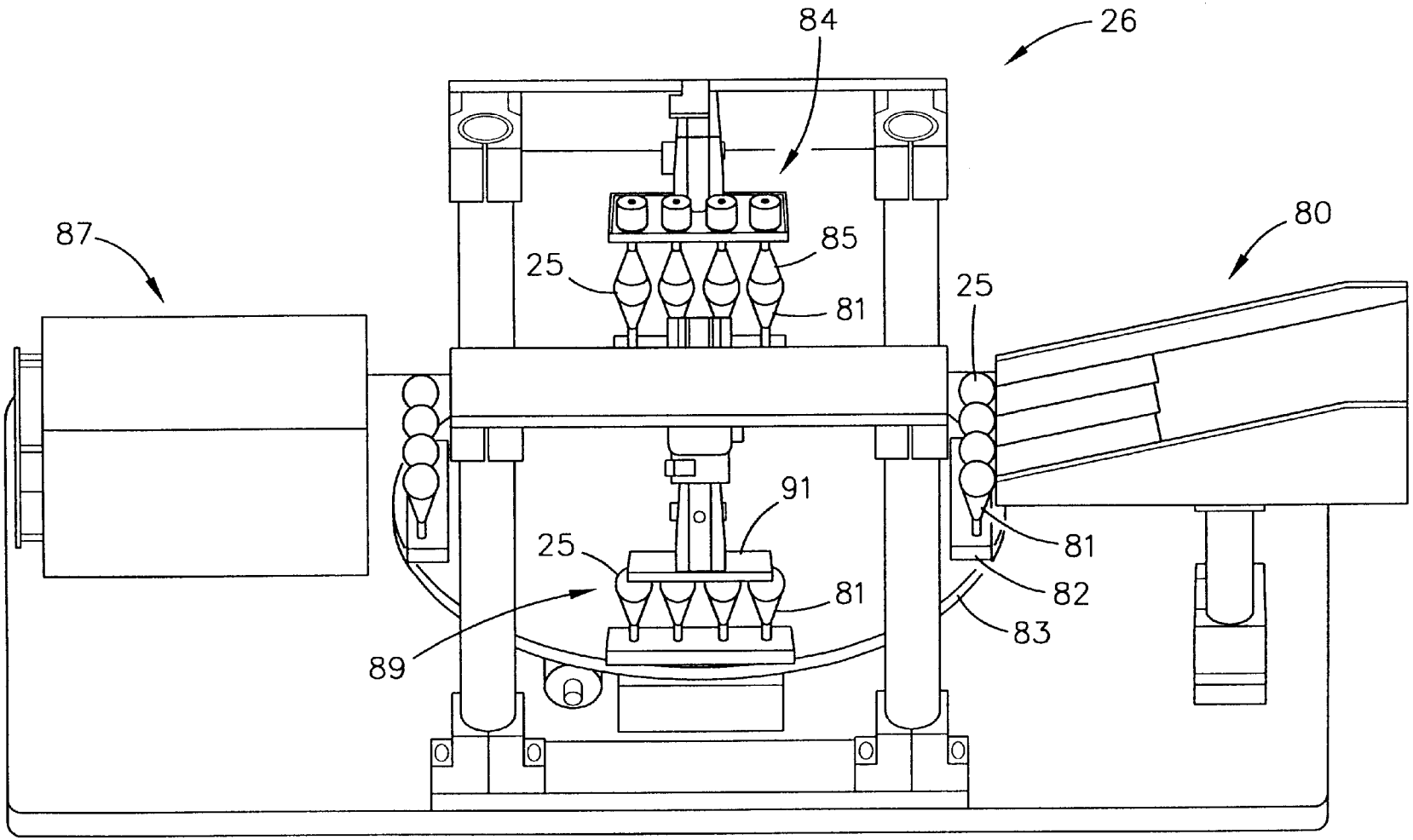
FIG. 2 is a top perspective of the whitening station of the present invention.
Figure 2A:
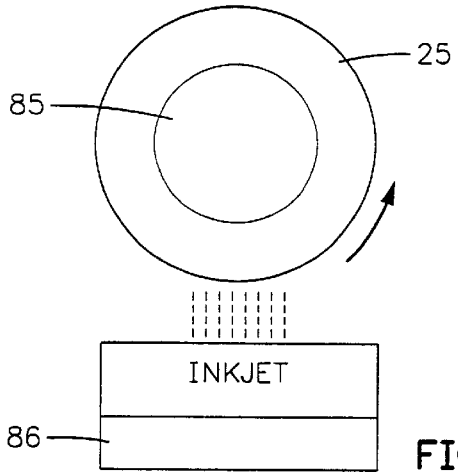
FIG. 2A is an isolated view of an inkjet whitening means of the present invention.
Figure 2B:
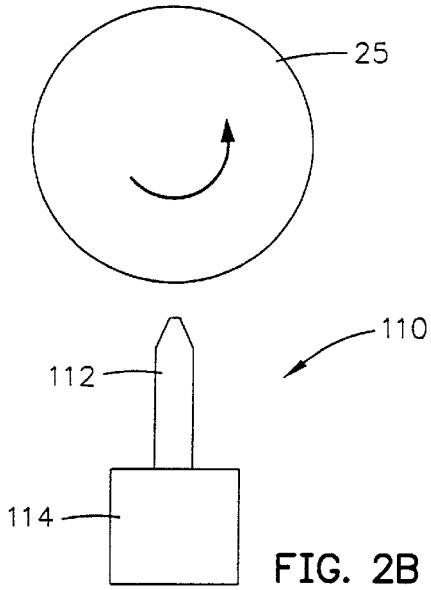
FIG. 2B is an isolated view of a paint nozzle whitening means of the present invention.
Figure 2C:
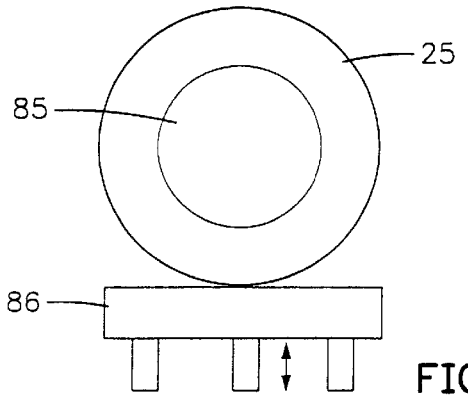
FIG. 2C is an isolated view of a pad printing whitening means of the present invention.

The preferred embodiment for the whitening station 26 is shown in FIG. 2. This embodiment has a transport hopper 80 that loads each of the golf balls 25 onto a cup 81. The cups 81 are disposed on a base 82 that is mounted on a rotating circular plate 83. The cups 81, with golf balls 25 placed therein, are rotated to a printing/painting substation 84. At the printing/painting substation 84, each golf ball 25 is engaged by an upper cup 85 to maintain the positioning and to assist in the rotation of each of the golf balls 25 during the whitening process. For the inkjet technique, each golf ball 25 is rotated about a central axis for whitening. A stepper motor preferably controls the rotation of each golf ball. A pneumatic cylinder or a servomotor preferably controls the vertical movement of each of the upper cups 85. The printing/painting substation 84 includes a whitening means 86 for whitening a portion of the golf ball 25 to prevent tip marks. The whitening means 86 preferably whitens a portion 120 of the golf ball 25.

In a preferred embodiment, the whitening means 86 is an ink jet printer that prints on the golf ball 25 as the golf ball 25 is rotated within the cups 81 and 85. Preferably, each golf ball 25 is allocated an inkjet printer, however, those skilled in the pertinent art will recognize that one inkjet printer may be used to whiten two or more golf balls 25 simultaneously. An inkjet machine that has one printhead per machine is available from Marconi Data Systems. An inkjet Dig machine that has four printheads per machine is available from Metronics.

Figure 3:
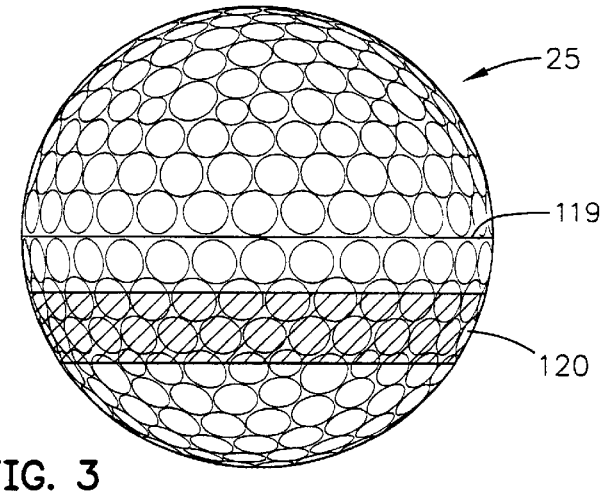
FIG. 3 is a side view of a golf ball with a whitened portion.
Figure 4:
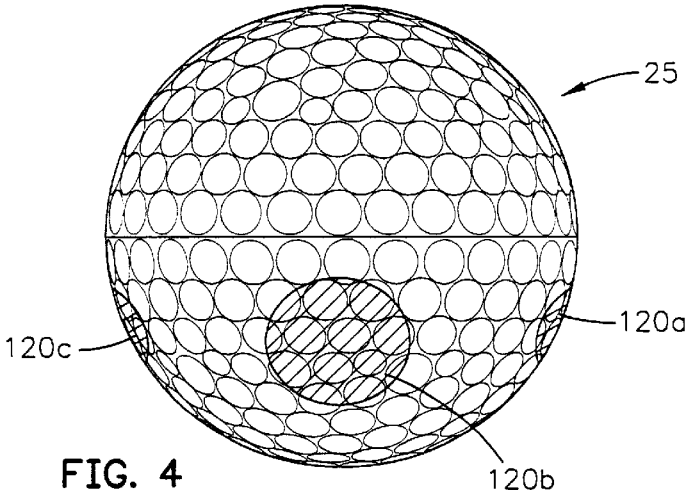
FIG. 4 is a side view of an alternative embodiment of a whitened golf ball.
Figure 5:
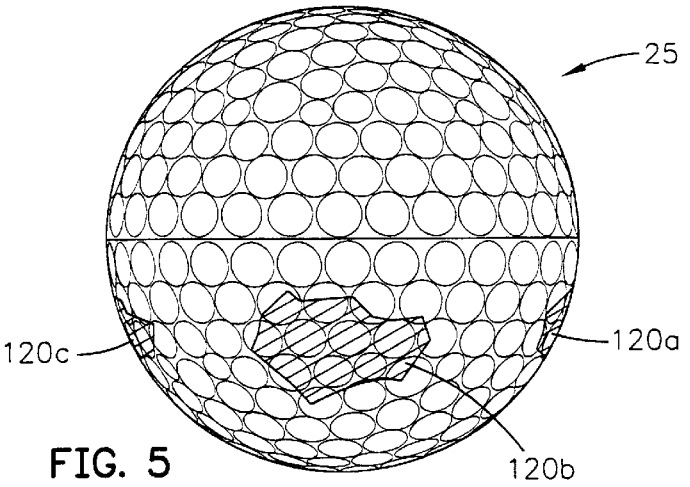
FIG. 5 is a side view of an alternative embodiment of a whitened golf ball.

An alternative whitening means 86 is a pad printer that prints on the golf ball 25 as the golf ball 25 is rotated within the cups 81 and 85. In such an embodiment, three whitening regions 120*a–c* are applied to the golf ball 25 as shown in FIGS. 4 and 5. In yet another alternative embodiment for pad printing, the golf balls 25 are separated a set distance from each other to allow for four pads to be lowered from above and to paint a stripe on the un-rotated golf balls 25 as shown in FIG. 3. Such a pad printing machine is available from Transtech Company of Chicago, Ill. In such an embodiment, only a portion of the pad has paint and the golf balls 25 must be flipped 180 degrees during off-loading and placement on the transfer means 24.

Yet in a further embodiment, the whitening means 86 is a paint nozzle in flow communication with a source of paint for painting a portion of the golf ball 25 as it is rotated within the cups 81 and 85.

FIGS. 3–5 illustrate different embodiments of the whitening portion 120 that may be applied to a golf ball 25 to overcome tip mark problems. In FIG. 3, the whitening portion 120 is applied as a strip around a circumference of the golf ball 25 approximately 0.25 inch below the equator/parting line 119 of the golf ball 25. The width of the strip of the whitening portion 120 is preferably between 0.25 inch and 0.50 inch. In the embodiments shown in FIGS. 4 and 5, the whitening portion is partitioned into three whitening portions 120*a*, 120*b* and 120*c* that correspond to the tip positioning of the tips 68.

After application of a whitening portion on the golf ball 25, each of the upper cups 85 are disengaged and elevated from each of the golf balls 25, and the plate 83 is rotated to transport the cups 81, with golf balls 25 therein, to the curing substation 87. Preferably, the ink utilized in the inkjet printer or the pad printer is an ultraviolet ("UV") light curable ink, and if the whitening means 86 is a paint nozzle then the paint is preferably an UV curable paint. Such UV curable inks and paints are well known in the art. Use of an UV curable ink or paint allows for immediate curing of the whitened portion of the golf ball 25. Thus, the golf balls 25 are capable of further processing without delay. The curing substation 87 includes an UV lamp 88, not shown, that is directed to irradiate the whitened portion of the golf ball 25. A preferred UV lamp is a Fusion type "V" bulb that is preferred for curing white UV ink. The golf balls 25 are rotated in front of the UV lamp which is directed at the stripe. Preferably, the UV radiation is limited to the whitened portion of the golf ball 25.

Figure 6:
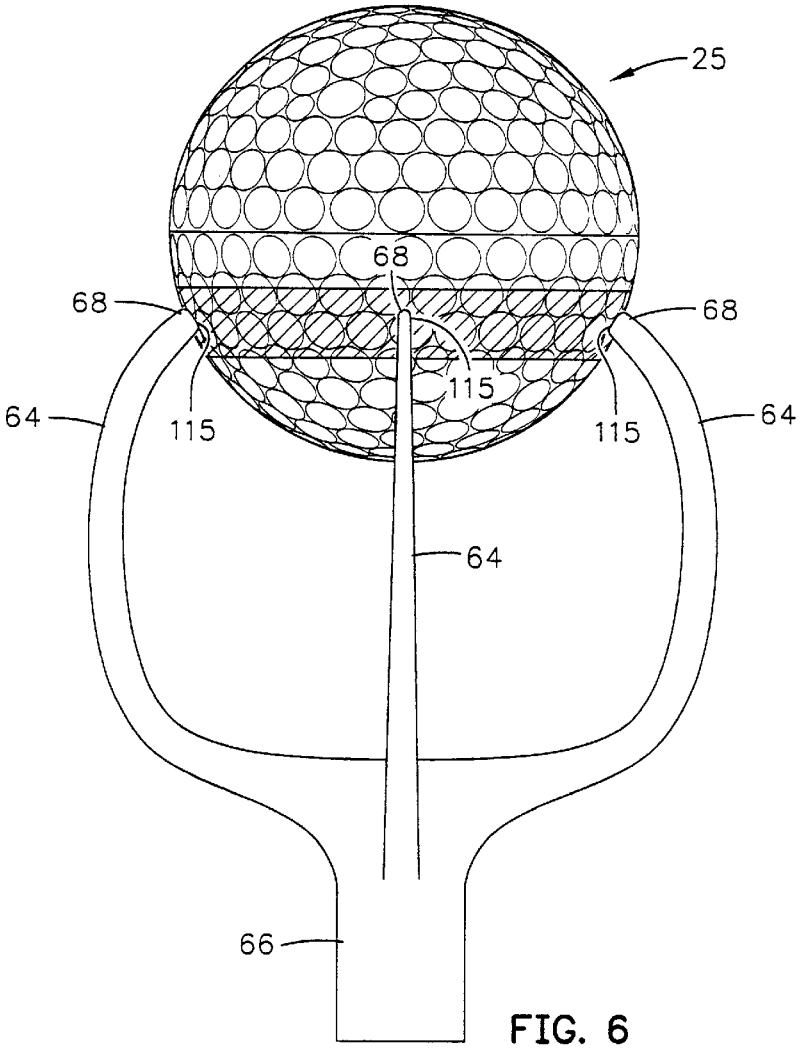
FIG. 6 is a side view of a whitened golf ball engaged with tips of a prong carrier.

After the curing substation 87, the plate 83 is rotated to transport the cups 81, with golf balls 25 therein, to a pick-and-place substation 89. The pick-and-place substation 89 includes a plurality of vacuum holders 90, not shown, for transport of the golf balls 25 from the cups 81 to the prongs 64 on the transfer means while maintaining the orientation of each the golf balls. The plurality of vacuum holders 90, not shown, is mounted on a moveable frame 91 that is capable of vertical and lateral movement. In operation, each of the holders 90 are lowered toward a corresponding golf ball 25 seated in a cup 81. A vacuum is exerted on each of the golf balls 25 to hold each in a respective holder 90. The moveable frame 91 is lifted thereby removing each golf ball 25 from its respective cup 81. Once each golf ball 25 is clear of its cup 81, the moveable frame 91 is laterally moved outward from the plate 83 for vertical orientation of each golf ball 25 on a prong 64, not shown. The moveable frame 91 is then lowered to place each golf ball 25 into a respective prong 64 such that the tips 68 of each prong 64 only engage the whitened portion 120 of the golf ball 25 at engagement points 115 such as shown in FIG. 6. As mentioned previously, one pad printing technique requires that each golf ball 25 is flipped 180 degrees.

Figure 7:
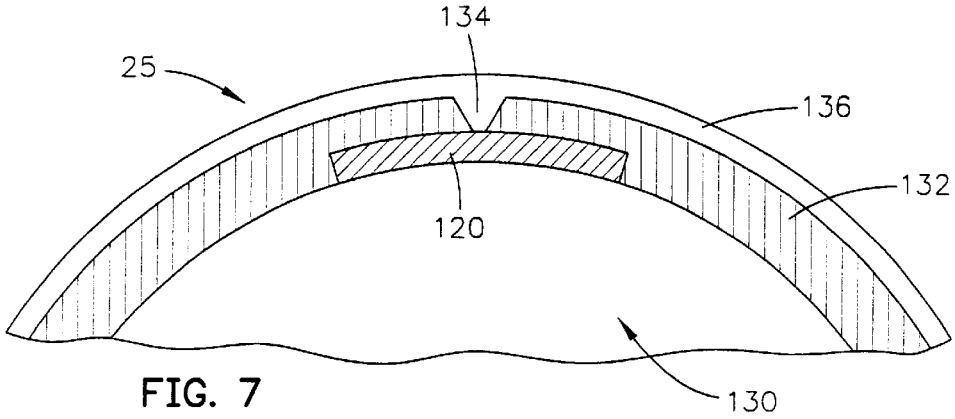
FIG. 7 is a cross-sectional view of the finish of the golf ball.

FIG. 7 illustrates a cross-sectional view of the finish construction of the golf ball 25. The finish is applied to a cover 130 that as previously mentioned may be composed of a polyurethane of ionomer material. The whitening portion 120 is applied to a portion of the cover 130. Then, at the first coating station 28, a base coat 132 is applied over the cover 130 and the whitening portion 120. A tip mark area 134 illustrates the need for the whitening portion 120 since the base coat 132 is prevented by the tip 68 from coating the tip mark area 134. Thus, in a polyurethane covered golf ball, such tip marks 134 could lead to exposed yellowing. An indicia, not shown, may be printed on the base coat 132 and then at the second coating station 34, a clear coat 136 may be applied over the base coat 132.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A method for finishing a golf ball, the method comprising:

applying a strip of white ink to a tip region on a surface of the golf ball;

holding the golf ball in a plurality of tips, each of the plurality of tips engaging the tip region;

applying a base coat to the surface of the golf ball while the golf ball is held in the plurality of tips; and applying a clear coat to the surface of the golf ball.

2. The method according to claim 1 further comprising curing the golf ball prior to applying the base coat.

3. The method according to claim 1 wherein the golf ball has a polyurethane cover.

4. A method for finishing a golf ball, the method comprising:

applying a white hot stamp decal to the tip region on a surface of the golf ball;

holding the golf ball in a plurality of tips, each of the plurality of tips engaging the tip region;

applying a base coat to the surface of the golf ball while the golf ball is held in the plurality of tips; and applying a clear coat to the surface of the golf ball.

5. The method according to claim 4 further comprising curing the golf ball prior to applying the base coat.

6. The method according to claim 4 wherein the golf ball has a polyurethane cover.

7. A method for finishing a golf ball, the method comprising:

pad printing a white ink on a tip region on a surface of the golf ball;

holding the golf ball in a plurality of tips, each of the plurality of tips engaging the tip region;

applying a base coat to the surface of the golf ball while the golf ball is held in the plurality of tips; and applying a clear coat to the surface of the golf ball.

8. The method according to claim 7 further comprising curing the golf ball prior to applying the base coat.

9. The method according to claim 7 wherein the golf ball has a polyurethane cover.

* * * * *